United States Patent [19]

Ishii

[11] 4,341,086

[45] Jul. 27, 1982

[54] REFRIGERATION SYSTEM

[75] Inventor: Heiichiro Ishii, Toda, Japan

[73] Assignee: Clarion Co., Ltd., Tokyo, Japan

[21] Appl. No.: 194,552

[22] Filed: Oct. 6, 1980

[51] Int. Cl.[3] ..... F25B 41/04

[52] U.S. Cl. ..... 62/225; 62/512; 55/185; 55/319; 55/418; 236/92 B

[58] Field of Search ..... 62/512, 199, 225; 236/92 B; 55/185, 319, 418

[56] References Cited

U.S. PATENT DOCUMENTS

| | | | |
|---|---|---|---|
| 2,128,020 | 8/1938 | Smilack | 62/199 |
| 2,148,413 | 2/1939 | Labberton et al. | 62/225 X |
| 2,637,985 | 5/1953 | Ray | 236/92 B X |
| 2,697,331 | 12/1954 | Zearfoss, Jr. | 62/512 X |
| 4,019,337 | 4/1977 | Zearfoss, Jr. | 62/225 X |
| 4,032,070 | 6/1977 | Nielsen | 62/225 X |

*Primary Examiner*—William E. Tapolcai, Jr.

*Attorney, Agent, or Firm*—Wallenstein, Wagner, Hattis, Strampel & Aubel

[57] ABSTRACT

A refrigeration system comprised of a compressor, a condenser, an expansion valve and an evaporator, wherein the expansion valve includes a means for separating a gaseous phase refrigerant generated within the valve from a liquid phase refrigerant so as to feed the liquid phase refrigerant to an inlet of the evaporator and the gaseous phase refrigerant to an outlet of the evaporator.

9 Claims, 6 Drawing Figures

REFRIGERATION SYSTEM

BACKGROUND OF THE INVENTION

1. Field of the Invention

This invention relates to a refrigeration system having a thermodynamic refrigeration cycle characteristic, and more particularly, but not by way of limitation, to a refrigeration system of the type for use in a car cooler and a domestic electric refrigerator.

2. Description of Prior Art

In a conventional refrigeration system, as illustrated in FIG. 1, a gaseous refrigerant is compressed by a compressor 1 so as to have a high temperature and a high pressure and fed to a condenser 2, where the gas is air-cooled or water-cooled so as to be condensed and liquefied. The so liquefied refrigerant has an ordinary temperature and a high pressure and is fed to an expansion valve 3 where the refrigerant is subjected to pressure reduction so that the temperature and pressure thereof are lowered and a portion of the refrigerant is gasified. Therefore, the refrigerant introduced into an evaporator 4 is a mixture of gaseous and liquid refrigerant. The mixing ratio is expressed in terms of dryness x and wetness $1-x$ according to a Mollier diagram. The refrigerant introduced into the evaporator 4 receives a heat load from the outside so that the liquid portion thereof is also gasified and recycled to the compressor 1. In this connection, it is to be noted that the liquid portion of the refrigerant effects a large work relative to the outside by the latent heat thereof, but the gaseous portion of the refrigerant can effect only a little work corresponding to a heat-sensing change. The work done is expressed in terms of a difference in enthalpy. For instance, the enthalpy difference by evaporation at 0° C. is 36.180 kcal/kg, while the enthalpy difference is 1.005 kcal/kg when a gas of 0° C. is overheated by 10° C. Thus, it is apparent that there is a significant difference between works done by liquid and gas. In this respect, it is further to be noted that the gaseous portion of the refrigerant fed from the expansion valve 3 to the evaporator 4 does little work and yet it lowers a heat conductivity (the heat conductivity of liquid is 8.8 times as large as that of gas) and increase a rate of flow (the specific volume of liquid is 13 times as large as that of gas) to lower a heat transmission coefficient. A passage 5 led from the expansion valve 3 to the evaporator 4 illustrated in FIG. 1 is, as known, to measure a temperature at an outlet of the evaporator for controlling a flow of the refrigerant to the expansion valve 3. In the system of FIG. 1, the expansion valve employed is of an internal pressure equalization type.

FIG. 2 illustrates another conventional system, wherein an external pressure equalization type expansion valve 3' is employed. In this case, a passage 6 for measuring a pressure at the outlet of the evaporator 4 is provided as well as a passage 5 for measuring a temperature at the outlet of the evaporator 4. The passage 6 is also led from the expansion valve 3' to the evaporator 4. A flow of the refrigerant to the expansion valve 3' is controlled by the temperature and pressure measured through the passages 5 and 6, respectively. The circulation route of the refrigeration in the system of FIG. 2 is indentical with that in the system of FIG. 1, so that the system of FIG. 2 involves similar problem to that of FIG. 1.

OBJECT OF THE INVENTION

It is therefore an object of the present invention to provide a refrigeration system which is capable of obviating the disadvantages involved in the known systems.

It is another, more specific object of the present invention to provide a refrigeration system which is capable of increasing the efficiency of an evaporator as compared with an evaporator of conventional systems having the same volume, without making the structure of the evaporator more complicated or larger than the conventional one.

SUMMARY OF THE INVENTION

In accordance with the present invention, there is provided a refrigeration system having a compressor, a condenser, an expansion valve and an evaporator which are connected to each other in the sequence, which refrigeration system is characterized in that said expansion valve is comprised of an expansion valve portion and a gas-liquid separating portion, said expansion valve portion being adapted to receive a refrigerant from said condenser and have said refrigerant subjected to adiabatic expansion there, said gas-liquid separation being adapted to receive a mixture of a liquid refrigement from the condenser and a gaseous refrigerant generated therefrom and separate said mixture into a liquid phase refrigerant and a gas phase refrigerant for introducing the liquid refrigerant to an inlet of the evaporator and introducing the gaseous refrigerant to an outlet of said evaporator.

DESCRIPTION OF THE PREFERRED EMBODIMENT

Figure 1:
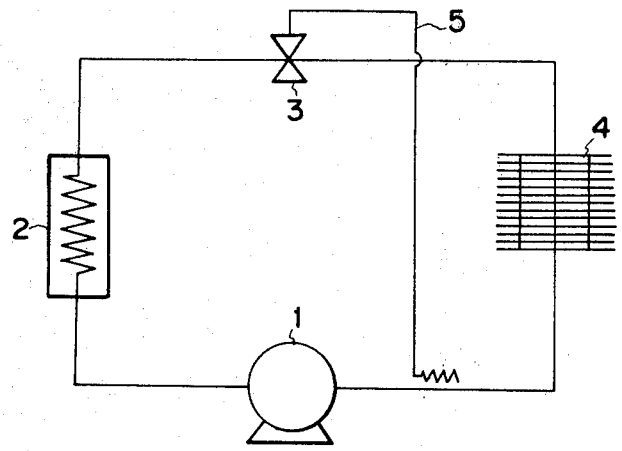
FIG. 1 (PRIOR ART)
FIGS. 1 and 2 are cycle system diagrams of conventional refrigeration systems employing an internal pressure equalization type expansion valve and an external pressure equalization type expansion valve, respectively.

Referring now to the drawings, there are illustrated preferred embodiments of the present invention.

Figure 2:
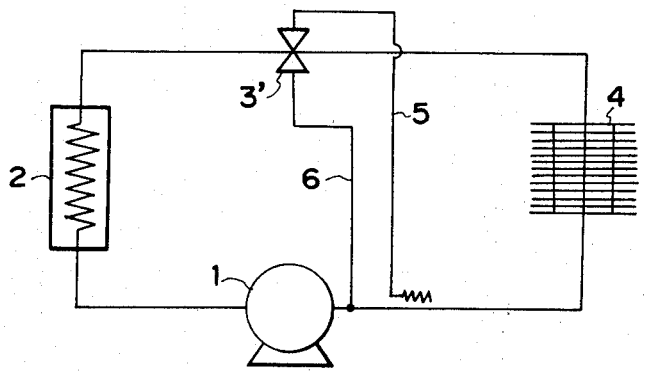
FIG. 2 (PRIOR ART)
Figure 3:
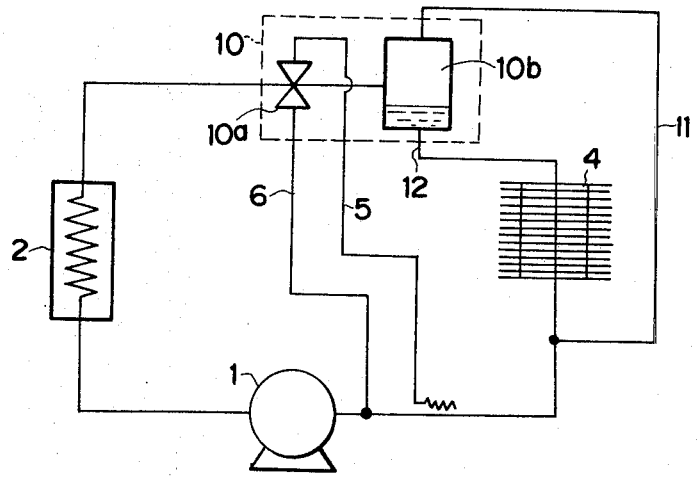
FIG. 3 is a cycle system diagram of a refrigeration system of the present invention for explanation of the operation theory of the invention.

FIG. 3 is a diagrammatic view illustrating a principle of the present invention. In the figure, parts or portions similar to those in FIGS. 1 and 2 are denoted by similar numerals.

A liquid refrigerant fed to an expansion valve 10 from a condenser 2 is subjected to an adiabatic expansion at an expansion valve portion **10*a* of the expansion valve 10, where a pressure of the liquid refrigerant is reduced and the refrigerant is partially gasified. Though a ratio of the gaseous refrigerant to the liquid refrigerant differs according to various conditions, it is generally about 3:7 by weight and about 34:1 by volume. In any case, a mixture of the liquid and gaseous refrigerant is introduced from the expansion valve portion 10*a* to a gas-liquid separating portion 10*b* of the expansion valve 10. At the gas-liquid separating portion 10*b*, the liquid refrigerant is separated from the gaseous refrigerant and the gaseous refrigerant is led to an outlet of an evaporator 4 by way of a bypass pipe 11. On the other hand, the liquid refrigerant is fed to an inlet of the evaporator 4 through a pipe 12**.

Thus, only the liquid refrigerant is fed to the evaporator 4, and the refrigerant shows its remarkable cooling ability due to a latent heat thereof. The refrigerant is then gasified and led from the evaporator 4 to a compressor 1 together with the gaseous refrigerant from the bypass pipe 11. More specifically, in the system of the present invention, the gaseous refrigerant, which cannot do work achievable by evaporation and can only do work by heat-sensing change, is bypassed to the outlet side of the evaporator 4 without feeding the same into the evaporator 4. Therefore, a limited inner volume of the evaporator 4 and heat exchanging surface area can be utilized more effectively as compared with the conventional refrigeration system. This allows improvement of a cooling ability of the evaporator 4.

Figure 4:
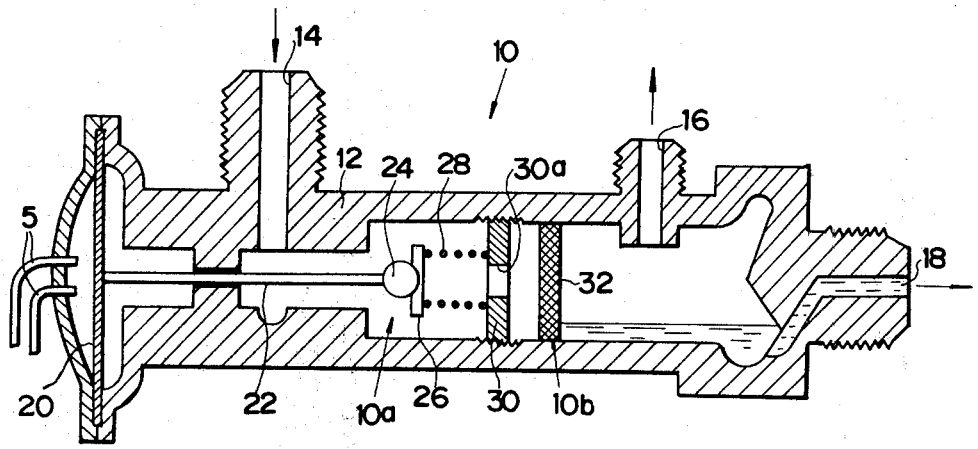
FIGS. 4 and 5 are longitudinal vertical sectional views of valves employed in the first and second embodiments of the present invention, respectively.

FIG. 4 is a longitudinal sectional view of an expansion valve 10 according to one specific embodiment of the present invention based on the principle of the present invention.

As can be seen from FIG. 4, the expansion valve 10 is comprised of an expansion valve portion 10i a and a gas-liquid separating portion 10*b* formed integrally with each other. The respective portions will now be described in detail. An expansion valve body 12 has, at a leftward end portion thereof as viewed in FIG. 4, a refrigerant inlet 14 for introducing a liquid refrigerant into the extension valve 10 from a condenser 2 and, on a rightward end portion thereof as viewed in FIG. 4, a gas outlet 16 for leading a gas separated from the liquid refrigerant at the gas-liquid separating portion 10*b* to a bypass pipe 11 as illustrated in FIG. 3. The body 12 further has, at a right end portion thereof, a liquid outlet 18 for introducing the liquid separated from the gas at the gas-liquid separating portion 10*b* to the evaporator 4.

A diaphragm 20 is secured at a left end portion of the body 12. To the diaphragm 20 is fixed a rod 22 adapted to be guided by a part of the body 12. A spherical member 24 is fixed to a tip end of the rod 22. The spherical member 24 is received by a plate 26 and the plate 26 is urged by a spring 28 in the leftward direction as viewed in FIG. 4. The spring 28 rests between the plate 26 and a disc 30 having a central opening 30*a*. A strainer or liquid gathering means 32 is provided on the right side of the disc 30 for aiding in the separating of the gas produced at the expansion valve portion 10*a* from the liquid by stopping the free passage of any liquid so that a body of liquid is formed which settles in the bottom of the body and then passes through the strainer 32. The so separated gas is led to the bypass pipe 11 through the gas outlet 16. The liquid, after passing through the strainer 32, is gathered in a groove formed on a bottom wall of the body 12 and led to the evaporator 4 through the outlet 18. A liquid recovering opening for leading the liquid from the groove to the outlet 18 is formed at a right end portion on an inner periphery of the body 12, and the position of the liquid recovering opening is indicated on the outside of the valve 10 so as to be located from the outside. When the expansion valve 10 is installed with its length in the horizontal direction as illustrated in FIG. 4, the expansion valve 10 is to be so disposed that the liquid recovering opening is positioned at the lower side. Instead of providing the indication on the valve 10 for the liquid recovering opening, the position of the opening may be fixed relative to the position of the gas outlet 16 so as to locate the position of the opening. Where an inner side wall of the body 12 is formed in a conical shape as illustrated in FIG. 4 and the gas outlet 16 is provided at a position leftward thereof, the expansion valve 10 may be installed vertically with the diaphragm positioned upwardly.

A capillary tube 5 connected at a left end portion of the body 12 correspond to the passage 5 in FIG. 3 and the tube 5 has one end positioned at the outlet of the evaporator 4 to measure a temperature at the position as can be seen from FIG. 3. The tube 5 is filled with a gas, so that the diaphragm 20 is bent leftwardly or rightwardly as viewed in the figure depending upon a pressure of the gas. Accordingly, the rod 22 with the spherical member 24 fixed thereto is moved leftwardly or rightwardly and a flow rate of the refrigerant into the expansion valve 10 is adjusted to provide a load suited for the evaporator 4.

Figure 5:
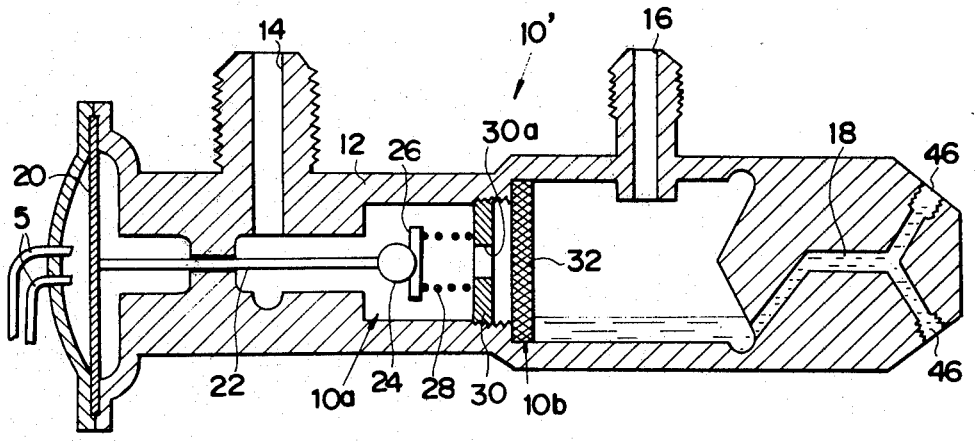

FIG. 5 illustrates another form of an expansion valve 10' in accordance with the present invention, wherein an expansion valve portion 10*a*, a gas-liquid separating portion 10*b* and a distributor portion 10*c* are formed integrally with each other.

Figure 6:
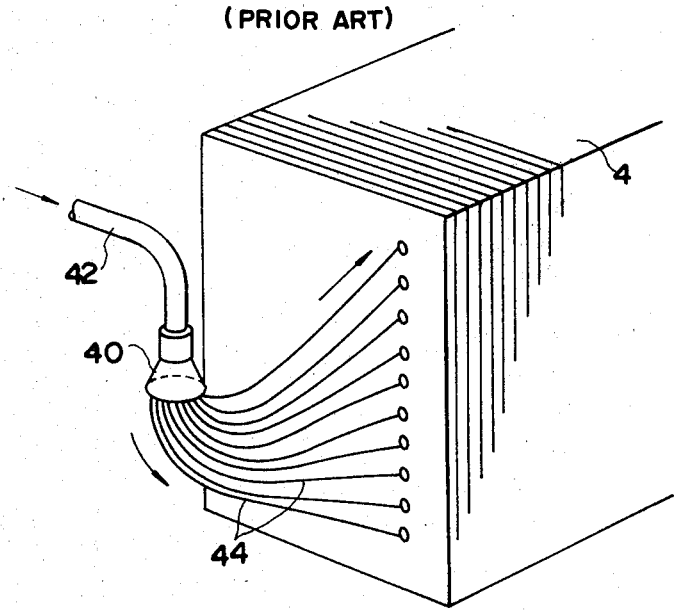
FIG. 6 (PRIOR ART)
FIG. 6 is a schematic perspective view of a part of a conventional refrigeration system for comparison with the embodiment of FIG. 5.

In general, to utilize the evaporator 4 effectively, a distributor 40 is provided between the expansion valve and the evaporator 4 as illustrated in FIG. 6. The refrigerant introduced from the expansion valve into a pipe is equally divided by the distributor and fed to various portions of the evaporator 4 through a plurality of pipes 44. However, since the refrigerant is partially gasified after it has been passed through the expansion valve, the refrigerant led to the pipe 42 in the conventional system is a mixture of the liquid and the gas. In addition, the refrigerant is liable to be divided into the liquid and the gas before it reaches the distributor due to various factors such as a distance from the expansion valve to the distributor 40, a flow rate, a resistance caused by piping, etc. Therefore, unless the gas phase refrigerant is uniformly mixed with the liquid phase refrigerant before distribution, there may occur ununiformed distribution of the refrigerant such that some pipes receive the refrigerant having a large gas content and other pipes receive the refrigerant having a large liquid content. This prevents an efficient operation of the evaporator 4 as a heat exchanger. By this means, the distributor employed in the conventional refrigeration system has a complicated inner structure to uniformly admix the gas and the liquid prior to distributing the refrigerant, and accordingly high precision is required in the manufacturing of the distributor.

In accordance with the present invention, the gas portion of the refrigerant which has been generated by passing through the expansion valve is led to an outlet side of the evaporator 4 through the bypass pipe 11, so that only the liquid portion of the refrigerant is introduced into the evaporator 4. Therefore, the structure of the distributor can be simplified. Furthermore, in the embodiment as illustrated in FIG. 5, since the distributor is formed integrally in the expansion valve 10', the entire structure of the refrigeration system can be further simplified.

In FIG. 5, parts or portions similar to those in FIG. 4 are denoted by similar numerals, and detailed explanation therefor is omitted. In the expansion valve 10' of the present invention, the expansion valve portion 10*a*, the gas-liquid separating portion 10*b* and the distributor portion 10c are formed integrally with each other as described above, and a plurality of refrigerant distributing passages are provided so as to extend radially from the liquid refrigerant outlet 18 and communicate with openings 46 formed on the right conical end of the body 12. These openings 46 are connected to plural pipes 44 as illustrated in FIG. 6, respectively. In accordance with the present invention, the distributor portion 10c can be simplified in structure and in addition, the size thereof can be reduced because only the liquid having a small specific volume flows therethrough. Thus, the manufacturing cost can be further reduced. The expansion valve 10' may be installed horizontally or vertically as in the first embodiment.

In the light of the foregoing description, the present invention has the following effects:

(1) The flow of the refrigerant through the evaporator can be reduced. While the heat transmission coefficient per unit area cannot be large enough in the conventional refrigeration system because a gas has a specific volume 13 multiple of that of a liquid and a rate of flow thereof is large, the heat transmission coefficient per unit area can be increased in the present system as compared with the conventional one because only the liquid refrigerant is introduced into the evaporator in the present refrigeration system. This means that present invention can increase the cooling ability of the system or reduce the size of the evaporator.

(2) A heat conductivity per unit area can be made larger because the heat conductivity of liquid is 8.8 multiple of that of gas. Thus, the efficiency of the evaporator can be enhanced.

(3) Sine the portion of the refrigerant which has been gasified immediately after passing through the expansion valve is recycled to the compressor without passing through the evaporator and accordingly being kept at a low temperature, overheating of the compressor can be prevented and the discharge temperature and pressure of the compressor can be lowered. This allows the capability of the condenser to be increased.

(4) When the condenser employed has a sufficient capability, a receiver tank can be omitted in a small scale refrigeration system, for not only the portion of the refrigerant gasified just after passing through the expansion valve but a gaseous refrigerant which fails to be liquefied due to incompetence of the condenser can be led to the bypass.

(5) The inner diameter of a pipe after expansion valve can be small because only the liquid refrigerant having a small specific volume passes therethrough.

The present invention as described above may be applicable not only to the refrigerators as stated at the outset but any refrigerator having a refrigeration cycle characteristic of inverse-Carnot's cycle. For example, the invention may be applied to a turbo-refrigerator for air-conditioning of a building.

I claim:

1. A refrigeration system having a compressor portion, a condenser portion, an expansion valve portion where liquid refrigerant from said condenser is subjected to adiabatic expansion to produce a gas-liquid mixture of said refrigerant; and an evaporator portion where the liquid portion of said mixture is to be evaporated, said various portions being connected to each other in the sequence named, said refrigeration system being characterized in that there is provided body means forming after said expansion valve portion a gas-liquid separating portion adapted to receive said liquid-gas mixture from said expansion valve portion said separating portion including a strainer-like means for impeding the free passage therethrough of the liquid portion of said mixture for collecting the liquid thereat which drops to the bottom of the body means on the inlet side of the strainer-like means and then flows through the strainer like means, said gas phase refrigerant passing above the collected liquid flowing through said strainer-like means, and outlet and conduit means for introducing the collected liquid refrigerant in the bottom of said body means to an inlet of the evaporator and the gaseous refrigerant above the same to an outlet of said evaporator.

2. A refrigeration system having a compressor, a condenser, an expansion valve and an evaporator which are connected to each other in the sequence, which refrigeration system is characterized in that said expansion valve is comprised of an expansion valve portion and a gas-liquid separating portion, said expansion valve portion being adapted to receive a refrigerant from said condenser and have said refrigerant subjected to adiabatic expansion there, said gas-liquid separation portion including means for receiving a mixture of a liquid refrigerant from the condenser and a gaseous refrigerant generated therefrom, separating said mixture into a liquid phase refrigerant and a gas phase refrigerant, and introducing the liquid refrigerant to an inlet of the evaporator and the gaseous refrigerant to an outlet of said evaporator, and said expansion valve portion having a body which is partitioned by a partition member having an opening to form said expansion valve portion and said gas-liquid separating portion integrally with each other, said expansion valve portion including a diaphragm fixed at an end portion of said body, a rod having an end fixed to said diaphragm, a spherical member fixed to another end of said rod and a spring biasing said rod through said spherical member, and said gas-liquid separating portion including a gas-liquid separating strainer.

3. A refrigeration system as claimed in claim 2, which further comprises a distributer provided between said expansion valve and said evaporator.

4. A refrigeration system as claimed in claim 2, wherein said body further comprises a distributor portion provided downstream of said gas-liquid separating portion and formed integrally therewith, said distributor portion being connected to said evaporator.

5. A refrigeration system having a compressor portion, a condenser portion, an expansion valve portion and an evaporator portion which are connected to each other in the sequence named, which refrigeration system is characterized in that there is provided after said expansion valve portion a gas-liquid separating portion; said expansion valve portion being adapted to receive a refrigerant from said condenser portion and have said refrigerant subjected to adiabatic expansion to form a gas-liquid mixture of the refrigerant, said gas-liquid separating portion including means for receiving said gas-liquid mixture, separating said mixture into a liquid phase refrigerant and a gas phase refrigerant and introducing the separated liquid refrigerant to an inlet of the evaporator portion and the separated gaseous refrigerant to an outlet of said evaporator portion, and said expansion valve portion and gas-liquid separating portion being formed by a common body which is partitioned by a partition member having an opening to form said expansion valve portion.

6. A refrigeration system as claimed in claim 5 wherein said body further comprises a distributor portion provided downstream of said gas-liquid separating portion and formed integrally therewith, said distributor portion being connected to said evaporator.

7. A refrigeration system as claimed in claim 5 wherein said expansion valve portion includes a diaphragm fixed at an end portion of said body, a rod having an end fixed to said diaphragm, and a member fixed to another end of said rod and a spring biasing said rod through said member.

8. The refrigeration system of claim 5 wherein said gas-liquid separating portion includes a strainer-like means which receives the liquid and gaseous refrigerant mixture before the separation thereof takes place; said strainer-like means impeding the free passage therethrough of the liquid portion of said mixture for collecting the liquid thereat which drops to the bottom of the body means on the inlet side of the strainer-like means and then flows through the strainer-like means, said gas phase refrigerant passing above the collected liquid flowing through said strainer-like means, and outlet and conduit means for introducing the collected liquid refrigerant in the bottom of said body means to an inlet of the evaporator portion and the gaseous refrigerant above the same to an outlet of said evaporator portion.

9. The refrigerating system of claim 1 wherein said gas-liquid separating portion includes a conical projection at one end portion of said body means downstream from said strainer-like means, said outlet means for the separated gas being a first exit from said body means at one side of the pointed end of said conical projection ahead of said pointed end and said outlet means for the separated liquid being a second exit from said body means on the opposite side of said pointed end of said conical projection at the base thereof so that said first exit is above said second exit whether said body means is oriented so that the pointed end of said conical projection faces horizontally or upwardly.

* * * * *